US006912356B2

(12) United States Patent
Arrison

(10) Patent No.: US 6,912,356 B2
(45) Date of Patent: Jun. 28, 2005

(54) METHOD AND APPARATUS FOR FRACTURING BRITTLE MATERIALS BY THERMAL STRESSING

(75) Inventor: Norman L. Arrison, Edmonton (CA)

(73) Assignee: Diversified Industries Ltd., Sidney (CA)

( * ) Notice: Subject to any disclaimer, the term of this patent is extended or adjusted under 35 U.S.C. 154(b) by 0 days.

(21) Appl. No.: 10/604,446

(22) Filed: Jul. 22, 2003

(65) Prior Publication Data

US 2004/0104216 A1 Jun. 3, 2004

Related U.S. Application Data

(63) Continuation of application No. 09/588,544, filed on Jun. 7, 2000, now Pat. No. 6,608,967.

(60) Provisional application No. 60/137,731, filed on Jun. 7, 1999.

(51) Int. Cl.[7] ..... H05B 3/00; E21C 37/20

(52) U.S. Cl. ..... 392/407; 299/14; 175/16; 241/1; 225/93.5

(58) Field of Search ..... 392/407–408, 392/421–422; 299/14; 175/11, 16; 241/1; 125/2; 225/93.5; 405/131

(56) References Cited

U.S. PATENT DOCUMENTS

| | | | | | |
|---|---|---|---|---|---|
| 914,636 | A | * | 3/1909 | Case | 299/56 |
| 1,679,857 | A | * | 8/1928 | France | 241/1 |
| 2,703,360 | A | | 3/1955 | Lipscomb | 362/225 |
| 3,520,455 | A | * | 7/1970 | Smith | 225/1 |
| 3,556,366 | A | * | 1/1971 | Kim | 225/1 |
| 3,589,883 | A | * | 6/1971 | Dear | 65/77 |
| 3,621,198 | A | * | 11/1971 | Herbrich et al. | 392/420 |
| 3,695,497 | A | * | 10/1972 | Dear | 225/2 |
| 3,751,657 | A | | 8/1973 | Sangiamo et al. | 362/294 |
| 3,797,757 | A | * | 3/1974 | Marshall | 241/1 |
| 3,826,537 | A | * | 7/1974 | Boyd et al. | 299/14 |
| 3,830,999 | A | * | 8/1974 | Yoshizumi et al. | 219/137 R |
| 3,860,903 | A | | 1/1975 | Steenhoven | 362/279 |
| 4,027,185 | A | | 5/1977 | Nodwell et al. | 313/35 |
| 4,109,144 | A | | 8/1978 | Vidmar | 362/247 |
| 4,201,921 | A | | 5/1980 | McCorkle | 250/493 |
| 4,700,102 | A | | 10/1987 | Camm et al. | 313/24 |
| 4,937,490 | A | | 6/1990 | Camm et al. | 313/12 |
| 5,084,604 | A | * | 1/1992 | Dekker et al. | 219/121.72 |
| 5,336,842 | A | | 8/1994 | Massholder et al. | 588/227 |
| 5,561,735 | A | | 10/1996 | Camm | 392/416 |
| 5,818,649 | A | | 10/1998 | Anderson | 359/726 |
| 5,966,836 | A | | 10/1999 | Valdez, III et al. | 34/448 |
| 6,226,454 | B1 | | 5/2001 | Couture | 392/419 |
| 6,435,555 | B1 | | 8/2002 | Seamon et al. | 428/553 |

FOREIGN PATENT DOCUMENTS

| | | |
|---|---|---|
| CA | 1015817 | 8/1977 |
| EP | 397 236 | 2/1990 |
| JP | 61 242273 | 10/1986 |
| JP | 01137515 | 11/1987 |
| SU | 83956 | 1/1979 |
| SU | 829931 | 7/1979 |

OTHER PUBLICATIONS

Clark, George B., "Rock Disintegration—the Key to Mining Progress", Mining Eng. V. 23, No. 3, pp. 47–51 Mar., 1971.

* cited by examiner

*Primary Examiner*—John A. Jeffery
(74) *Attorney, Agent, or Firm*—Bennett Jones LLP

(57) ABSTRACT

A method of fracturing or breaking rock includes the step of directing high intensity white light (radiation) at the rock to induce thermal stress sufficient to fracture the rock. The intensity of the energy source may be varied to control the manner in which the rock fractures. An approach for generating high intensity white light includes an elongate arc chamber and an elongate concave reflector. The arc chamber and reflector may be shielded from airborne particulate matter by an air shield or a rotating or reciprocating translucent shield.

7 Claims, 5 Drawing Sheets

METHOD AND APPARATUS FOR FRACTURING BRITTLE MATERIALS BY THERMAL STRESSING

CROSS REFERENCE TO RELATED APPLICATIONS

The present application is a continuation of application 09/588,544 filed Jun. 7, 2000 now U.S. Pat No. 6,608,967 entitled "Method And Apparatus For Fracturing Brittle Materials By Thermal Stressing " which claims priority to U.S. Provisional Patent Application Ser. No. 60/137,731 filed on Jun. 7, 1999. The contents of both prior applications are incorporated herein by reference.

BACKGROUND OF INVENTION

The present invention relates to methods and apparatus for fracturing rock, ceramics, concrete and other materials of low elasticity. The invention relates in particular to methods and apparatus for fracturing rock for purposes of mining, excavation, and demolition.

Mining and excavation of rock is commonly carried out using explosives. Typically, sticks of explosive are placed in holes drilled into the rock and then detonated, thereby explosively fragmenting a portion of the rockface being worked on. The rock debris created by the explosion is cleared away, and preparations begin for another blast.

The blasting method described above is time-consuming and expensive. Each blast takes a considerable time to set up and carry out. A large number of holes must be drilled into the rockface and the explosives placed in the holes, carefully interconnected with fusing apparatus to ensure that they detonate simultaneously. The resultant blast can throw rock debris large distances, unless the configuration of the blast is such that heavy and expensive blasting mats can be put in place to cushion the explosion and prevent the blast debris from flying away. As with any operation employing explosives, the blasting method also is inherently hazardous to the persons involved.

Accordingly, there is a need for rock mining and excavation methods, which are faster and more efficient and thus less expensive than conventional blasting methods. There is also a need for rock mining and excavation methods, which eliminate or substantially reduce the safety hazards associated with conventional rock blasting practices.

One possible alternative to conventional mining methods is to fracture the rock by means of thermal stress. It is well known that solid materials can fracture due to internal stresses induced by a large and sudden temperature change. A simple example of this is the shattering of a piece of glassware plunged into cold water after having been heated. Similarly, rock will shatter if it undergoes a temperature rise great enough and sudden enough to induce internal tensile or shear stresses exceeding the inherent tensile or shear strength of the rock. This would be a desirable result for purposes of rock mining and excavation. Material near the surface of a rock mass would be heated rapidly, and resultant thermal stresses would fracture the rock. The fractured material may then be removed, and the process repeated on the fresh rock thus exposed, and so on until a desired amount of rock has been removed.

The practical difficulty with this concept, of course, is how to create such a sufficiently sharp and intense temperature rise in the surficial zone of a rock mass, before the heat thus transferred to the rock can be dissipated by conduction throughout the rest of the rock mass. Conventional flame-heat sources, however, are not capable of achieving the desired result. An acetylene-oxygen flame, for example, can achieve a maximum temperature of approximately 3,100° C., but tests have indicated that even a flame this hot is not effective for producing thermal stresses intense enough to fracture rock effectively.

In U.S. Pat. No. 3,826,537 to Boyd, a tunnelling apparatus includes both thermal and mechanical energy. The rock is heated with tungsten filament infrared lamps and then subjected to an impactor in order to excavate the rock. Tungsten filament lamps may produce temperatures of about 2200° C. (4000° F.). Again, these sources of heat are insufficient to reliably fracture rock unless it is susceptible to fracture by containing large amount of impurities or water. At these slower rates of heating, tensile stresses only are produced in the rock, resulting in deep fissures or cracking. These tensile cracks may not permit efficient excavation in a tunnelling procedure and in fact may damage the tunnel wall strength. Efficient excavation may only take place with a combination of thermal and mechanical energy.

Accordingly, there is a need for improved methods of fracturing rock or other brittle materials using a radiant energy source.

SUMMARY OF INVENTION

In general terms, the present invention is the use of a high-intensity arc lamp to induce thermal stress fracture in brittle materials such as rock, ceramics or concrete. A preferred embodiment of the arc lamp may operate at about 12,000° C. and generates electromagnetic energy in the infrared, visible light, ultraviolet spectrum and approaching the long x-ray spectrum.

Therefore, in one aspect, the invention may comprise a method of fracturing rock by inducing shear stress on the rock surface which cannot be done with only infrared energy produced by heating with infrared lamps, comprising the step of directing white light generated by a high-intensity arc lamp operating in excess of 4000° C. onto the rock surface. Preferably, the arc lamp operates in excess of 8000° C. and more preferably at about 12,000° C. At such elevated temperatures, a significant proportion of the energy produced is in the ultraviolet and shorter wavelengths.

Stefan's Law provides that the rate of energy transfer by radiation varies as the fourth power of the temperature. Therefore, a doubling of the temperature of a radiation source results in a 16-fold increase in the rate of energy transfer. This can be illustrated by the well-established equation for radiant energy transfer, as follows:

$$Q=\sigma EFA(T_1^4-T_2^4)$$

wherein: Q=amount of energy transferred
σ=Stefan-Boltzmann constant
E=emissivity
F=shape factor
A=area
$T_1$=temperature of energy emitting source
$T_2$=initial temperature of energy absorber This equation may be used to compare the amounts of energy transferred to an object by a white light source and by a flame source. Factors σ, E, F, and A will be constant for each case. Given that $T_1$ will be far greater than $T_2$ in either case, it is evident on inspection that the term $(T_1^4-T_2^4)$ may be reduced to merely $T_1^4$ without significant loss of accuracy. It follows, therefore, that:

$$Q_I/Q_F=T_{1L}^4/T_{1F}^4=(T_{1L}/T_{1F})^4$$

where: $Q_L$=amount of energy transferred to energy absorber by light source $Q_F$=amount of energy transferred to energy absorber by flame source $T_{1L}$=temperature of light source $T_{1F}$=temperature of flame source Therefore, if the temperature of the light source is 12,000° C., and the temperature of the flame source is 3,100° C., the energy transfer from the light source will be $(12{,}000/3{,}100)^4$ or about 225 times greater than that of the flame source.

In another aspect of the invention, the invention comprises a method of fracturing rock by inducing shear stress or tensile stress, or shear stress and tensile stress in the rock by directing radiative energy generated by a high-intensity arc lamp and varying the intensity of the arc lamp to achieve either shear stress or tensile stress, or shear stress and tensile stress. The very rapid energy transfer rates enabled by the high temperature arc lamp source permits fracturing of surface layers of the rock by inducing shear stress. This is important for tunnelling because the integrity of the tunnel walls is protected.

BRIEF DESCRIPTION OF DRAWINGS

Embodiments of the invention will now be described with reference to the accompanying drawings, in which numerical references denote like parts, and which.

DETAILED DESCRIPTION

Figure 1:
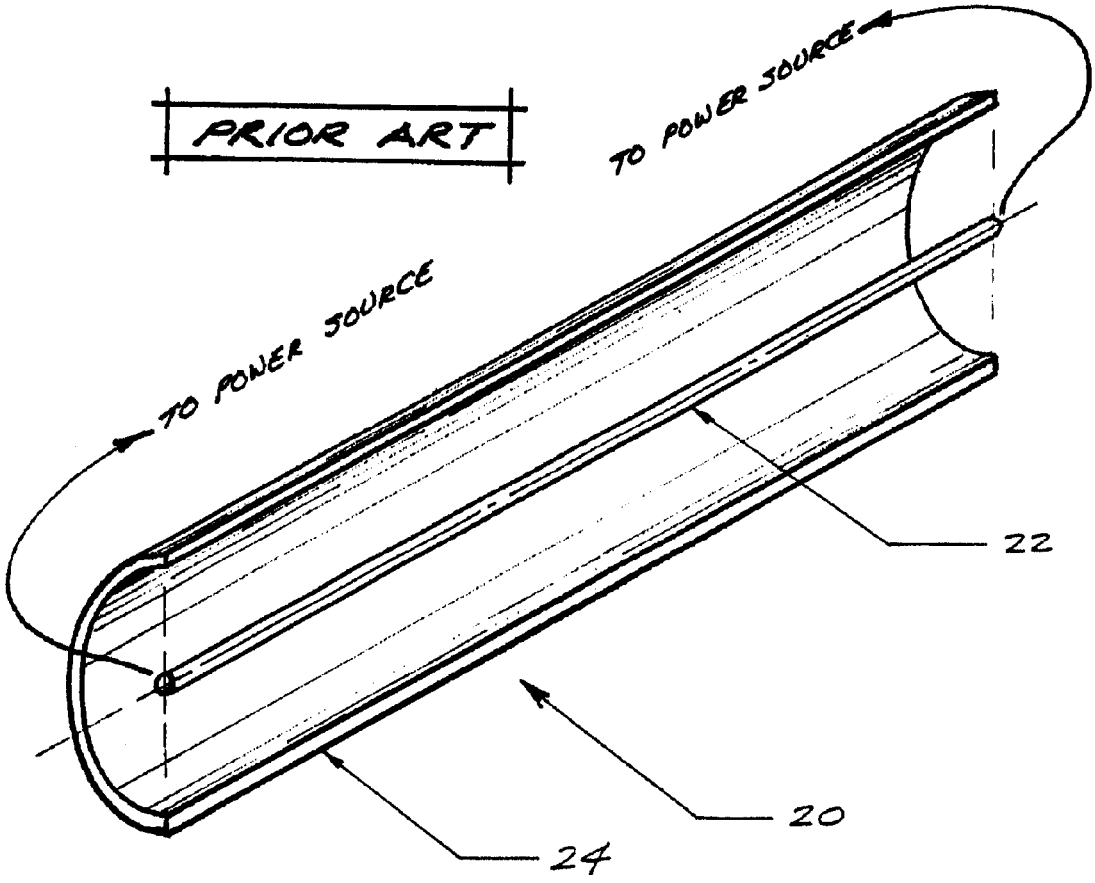
FIG. 1 is schematic isometric drawing of a high-intensity arc lamp known in the prior art.

The present invention provides for a method of fracturing rocks and other brittle materials by means of an arc lamp which may reach temperatures of greater than 4000° C. and preferably in the range of about 12,000° C. Such extremely high temperatures means that the arc lamps of the present invention may transfer energy to rock approximately 200 to 250 times faster than a acetylene torch flame or tungsten filament infrared lamps are able to do because almost all heat is transferred by radiation at high temperatures. Stefan's Law of Radiation reproduced above demonstrates that amount of energy transferred by radiation varies as the fourth power of the temperature difference between the radiation source and the radiation target.

Unexpectedly, the inventors have found that the extremely high temperatures of the arc lamp source permits rock breaking by inducing shear which stress which causes the rock to peel off like flat plates. At its highest intensity levels, the inventors have found that the surficial layers of the rock are actually vapourized and the underlying layers are rapidly removed because of the shear stress created. At lower rates of energy transfer, as in the prior art, the rock will break as a result of tensile stress in deep fissures or cracks which run longitudinally through the rock. Accordingly, in one embodiment of the invention, the nature of the stress induced, and the resulting fracture, may be controlled by controlling the rate of energy transfer to the rock. Accordingly, one may vary the nature of the rock fracture by varying the intensity of the arc lamp as a radiative energy source.

U.S. Pat. No. 4,027,185 issued to Nodwell et al. on May 31, 1977, U.S. Pat. No. 4,700,102 issued to Camm et al. on Oct. 13, 1987, and U.S. Pat. No. 4,937,490 issued to Camm et al. on Jun. 26, 1990, the contents of which are incorporated herein by reference, disclose closely similar arc lamps capable of generating white light radiation at temperatures as high as 12,000 degrees Celsius, considerably hotter than the temperatures which can be achieved with flame heat and produce an electromagnetic spectrum above what can be achieved with infrared heat. These arc lamps have been developed and used for such applications as simulating, for purposes of scientific experiments, the high temperatures produced by nuclear explosions. The energy generated by these arc lamps is intense enough to expand rock fast enough to produce thermal-stress-induced fracture, and in fact is capable of transferring energy at least an order of magnitude faster than any heat source using infrared electro magnetic radiation called heating.

White light arc lamps of the type taught by Nodwell et al. and Camm et al. feature a hollow, elongate quartz arc chamber positioned within an elongate concave reflector. The reflector is hollow, so that liquid coolant may be circulated through the reflector to prevent it from becoming overheated under the intense heat generated by the arc chamber. For proper operation, this type of arc lamp requires an extremely clean environment. Even tiny amounts of dust or dirt on the quartz arc chamber or the reflector can cause the lamp to fail, or to function with significantly reduced effectiveness.

For these reasons, white light arc lamps have typically been used only in controlled environments such as experimental laboratories. If used, unmodified, for thermal-stress-induced fracturing of rock, they would likely malfunction because of the dirty air typically associated with rock mining and excavation operations. One apparent possible solution to this problem would be to enclose the arc chamber and reflector inside a translucent cover, thereby shielding them from airborne particles while allowing light to pass through. The solution cannot be quite this simple, however; airborne particles would build up on the cover, melt under the intense heat from the lamp, and interfere with the transmission of light from the lamp. Therefore, any cover over the arc chamber and reflector would have to be kept extremely clean, even in a dirty environment.

FIG. 1 schematically depicts a high-intensity arc lamp known in the prior art, generally indicated by the reference number (20). This device has an elongate light bulb referred to as an arc chamber (22), and a concave reflector (24) disposed substantially co-axially around the arc chamber (22). Light generated by the arc chamber (22) is focused by and reflected outwardly from the reflector (24). The arc chamber comprises a cylindrical quartz tube within which a high intensity arc discharge between two electrodes is provided. Such arc chambers (22) are well known in the art. Suitable arc chambers may be as described in the Nodwell, et al. and Camm, et al. patents referred to above or may be available from Vortek Industries, Vancouver, British Columbia. A suitable arc lamp is also described in co-owned and pending U.S. Pat. Application. Ser. No. 60/319,879, the contents of which are incorporated herein by reference.

The reflector (24) directs the light to the target and must be water cooled to withstand the heat generated by the arc chamber. In one embodiment, the reflector defines internal water cooling passages (not shown) and baffles designed to allow water to flow through the reflector and cool the reflector.

Arc lamps having arc chambers which generate sufficient radiant heat energy may be used to fracture rocks. The lamp may be positioned close to the rock or rock surface which is to be fractured and turned on until the rock fractures. The distance from the lamp to the rock and the focus of the radiation may be adjusted to suit the needs of the application. In one embodiment, the distance between the arc chamber and the surface of the rock to be fractured may be about 10 centimeters to about 100 cm or more. The distance will depend on the size and susceptibility to of the rock to radiation energy transfer and the power of the arc lamp and the length of time of exposure. The time of exposure may vary from a few seconds to 30 minutes or more.

Figure 1A:
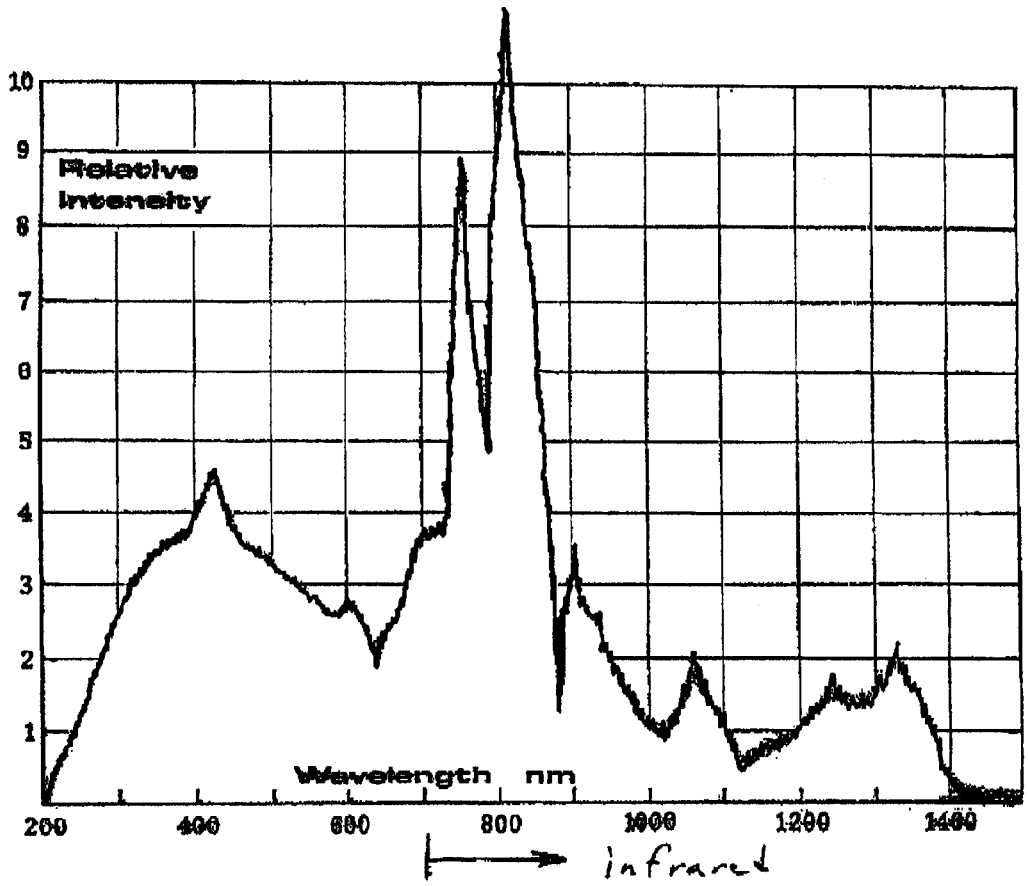
FIG. 1A is a spectral distribution graph of the energy output of an arc lamp of the present invention.

FIG. 1A shows the spectral distribution of the energy output of an arc lamp of the present invention. A significant proportion of the energy produced is in the region having wavelengths less than 500 nm (above infrared), with a peak at about 420 nm. In the present invention, it is believed that the high energy shorter wavelength electromagnetic energy permits the very rapid energy transfer rates which may be achieved with the present invention. Prior art infrared lamps do not produce any significant energy below the visible wavelengths.

An arc lamp of the present invention may include means for varying the intensity of the lamp, which may comprise an electrical voltage or current regulator connected to the lamps power source.

As referred to above, it is very important to keep particulate matter such as dust and debris away from the arc chamber (22) and reflector (24). In one embodiment, this is accomplished by flowing a clean air stream past the reflector and arc chamber as an air shield so that dust and debris cannot get to the arc chamber and reflector.

Figure 2:
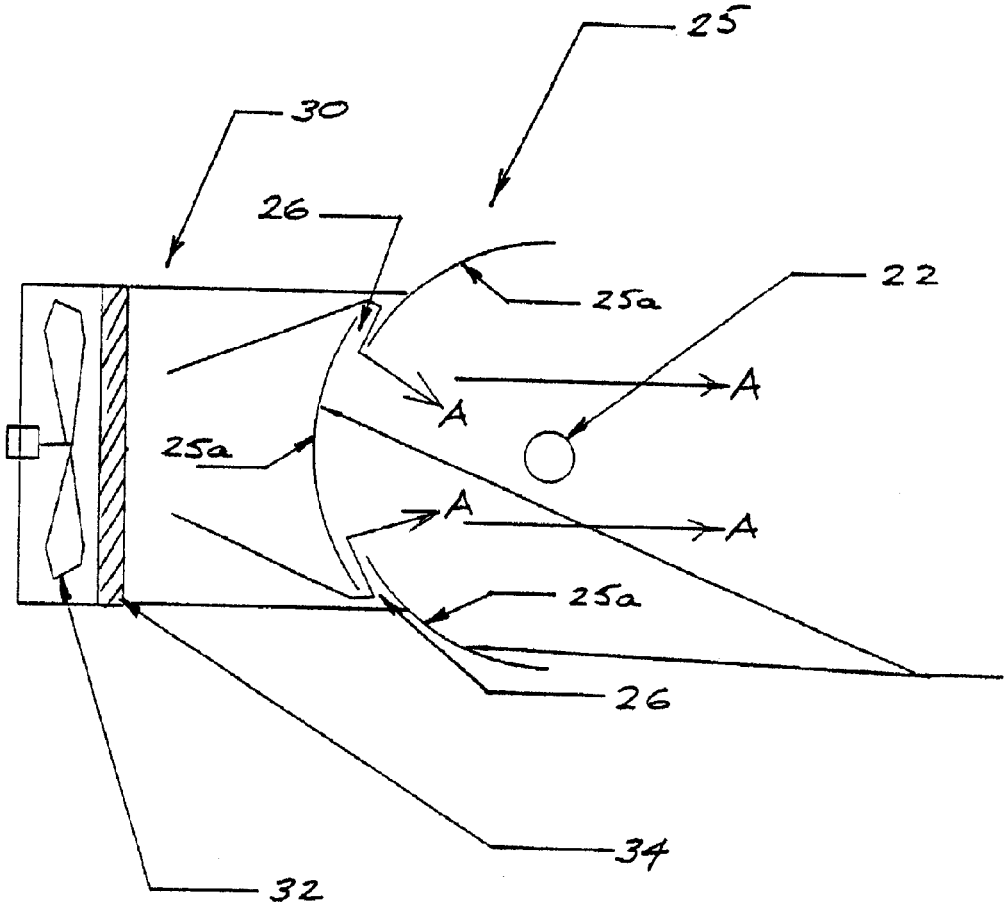
FIG. 2 is a schematic drawing of a high-intensity arc lamp equipped with the air shield and reflector apparatus of the present invention.

FIG. 2 conceptually illustrates one embodiment of an air shield apparatus of the present invention, being a modification of the prior art high-intensity arc lamp described above. This apparatus has a segmented reflector (25) made with a number of reflector segments (25*a*) which define air passages (26) between them. An air plenum (30) positioned behind the segmented reflector (25) carries air from a compressed air source (not shown). The air is forced through the air passages (26), and is directed over, around, and outwardly away from the arc chamber (22), all as conceptually indicated by arrows "A". The air is forced over, around, and away from the arc chamber (22) with sufficient velocity to deflect airborne particulate matter away from the arc lamp and thus to prevent such matter from coming in contact with the arc chamber (22).

In the preferred embodiment, a fan (32) is provided to increase the velocity of the air flowing through the air plenum (30). As well, an air filter (34) is interposed between the plenum (30) and the fan (32) in order to minimize or eliminate particulate matter which might be present in the compressed air, and which otherwise might come into contact with the arc chamber (22) and impair its function. Also in the preferred embodiment, cooling means (not shown) will be provided in association with the air plenum (30) to cool the air passing therethrough, so as to provide enhanced cooling of the segmented reflector (25) and the arc chamber (22).

In an alternative embodiment utilizing the air shield (not shown), the reflector may be unitary and air may be flowed past the reflector and arc chamber along the longitudinal axis of arc chamber. The specific direction of air flow is unimportant so long as clean or filtered air flows past the reflector and arc chamber and ultimately towards the potential source of dust or debris so that the air stream acts as a shield.

In another aspect of the invention, the arc lamp may be shielded from dust and debris by a transparent shield. However, as noted above, the arc lamp must be modified to keep the shield clean and free of dust and debris.

Figure 3:
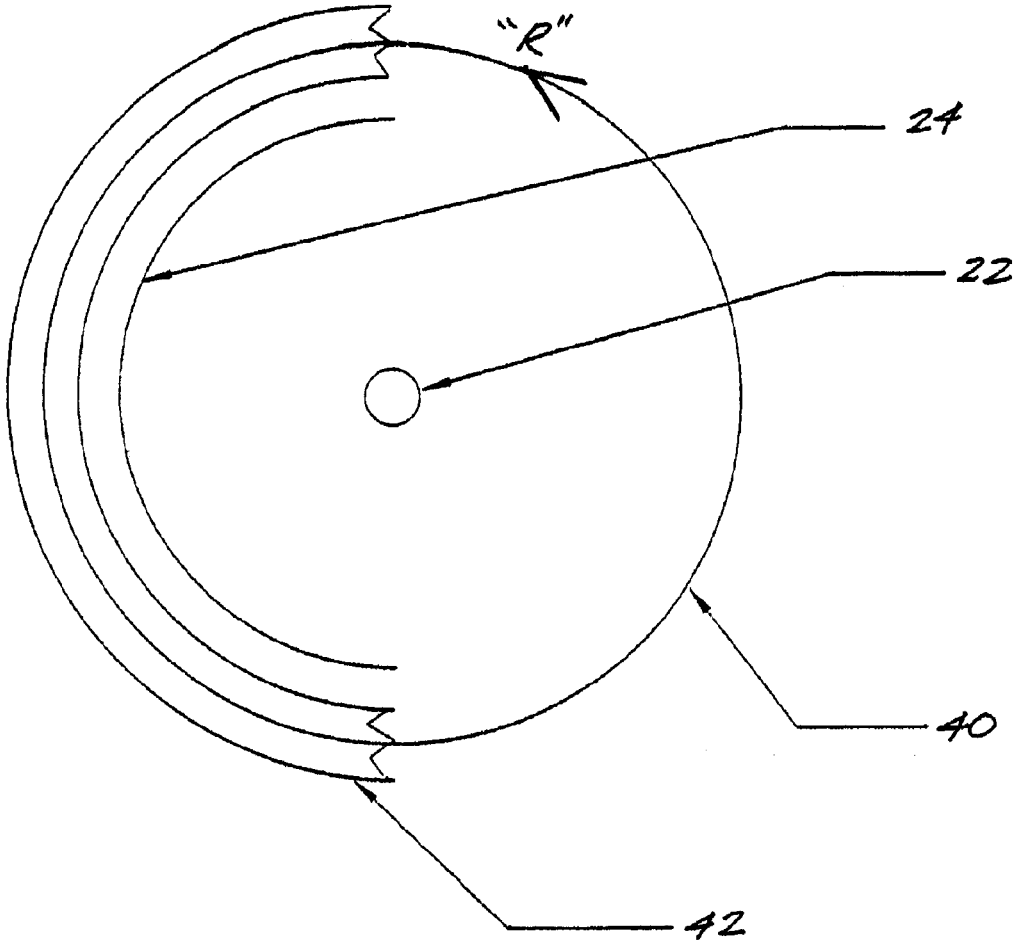
FIG. 3 is a schematic drawing of a high-intensity arc lamp equipped with an embodiment of the translucent cylindrical shield apparatus of the present invention.

FIG. 3 illustrates an embodiment of this aspect of the present invention, in which a high-intensity arc lamp, having an arc chamber (22) and a water-cooled reflector (24), is fitted with a translucent cylindrical shield (40). The cylindrical shield (40) is mounted to the arc lamp so as to enclose, and to rotate substantially coaxially around, the arc chamber (22) and the reflector (24). As it rotates, the cylindrical shield (40) passes continuously through a shield-cleaning chamber (42) formed between two semi-cylindrical members (41*a*, 41*b*). FIG. 3 shows the cylindrical shield (40) rotating counter-clockwise, as indicated by arrow "R", but it could be rotating clockwise with substantially the same effectiveness. Also, the cylindrical shield (40) need not rotate continuously in one direction. In one embodiment, the cylindrical shield may stop and reverse itself after making a full turn or a half turn. The object is to periodically clean the shield in the cleaning chamber (42) and to return it in position in front of the arc lamp. The speed of rotation may be varied in accordance with the conditions. In extremely dirty conditions, it may be necessary to rotate the shield (40) at a higher speed.

The cylindrical shield (40) provides a physical barrier preventing airborne particulate matter from coming in contact with the arc chamber (22). Undesirable accumulation of particulate matter on the cylindrical shield (40) is prevented or minimized by the continuous cleaning action of the shield-cleaning chamber (42). Disposed within the cleaning chamber (42) may be cleaning elements (not shown) in contact with the shield (40) such as wiper blades or soft cloths which clean the shield as it rotates within the cleaning chamber (42). The cylindrical shield may be slightly pressurized from the inside with a source of clean or filtered air so as to prevent particulate matter from entering inside the cylindrical shield. This configuration would also accommodate expansion and contraction of the air resulting from the heat generated by the arc chamber during operation.

The cylindrical shield (40) may be rotated by a chain or belt (not shown) driven by an electric or hydraulic motor or by any other suitable mechanical means for rotating the shield.

Figure 4:
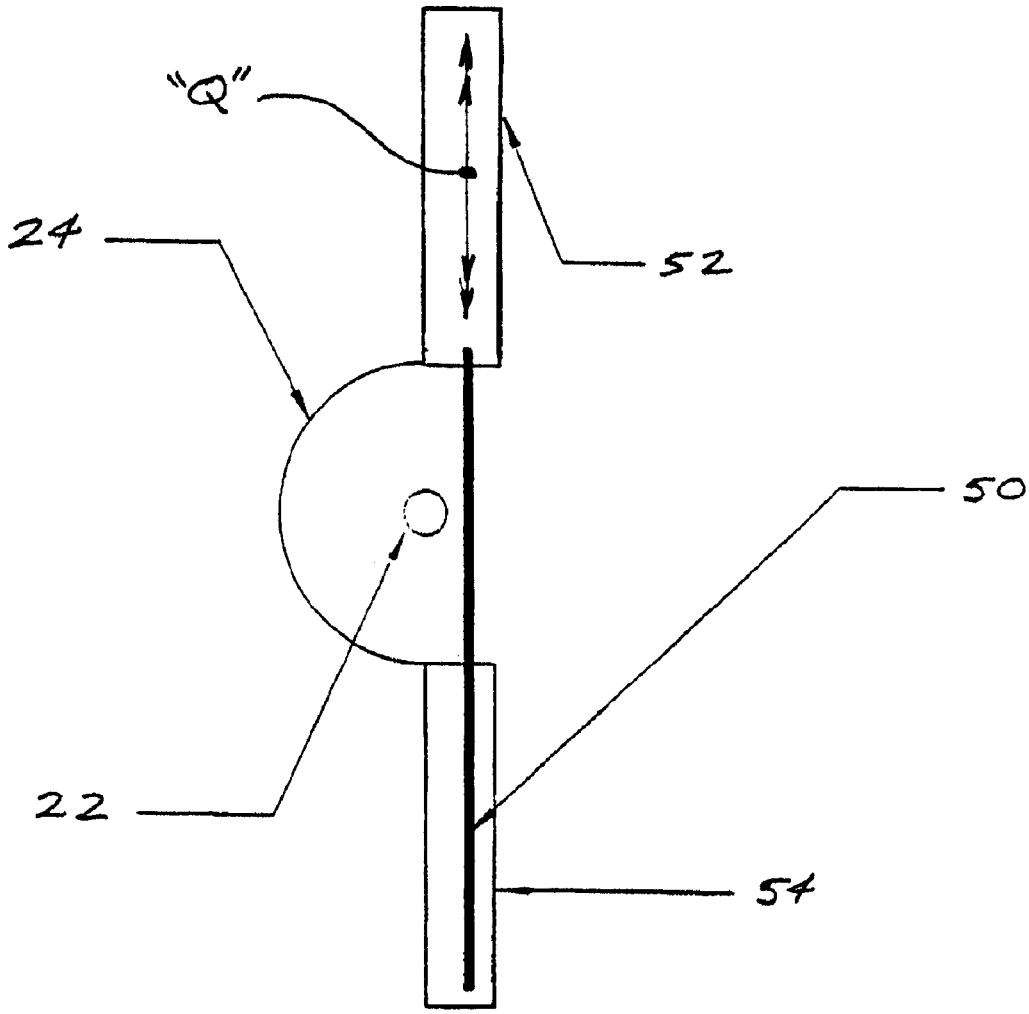
FIG. 4 is a schematic drawing of a high-intensity arc lamp equipped with an embodiment of the translucent planar shield apparatus of the present invention.

FIG. 4 illustrates a further embodiment of the shielding apparatus of the present invention. In this embodiment, a high-intensity arc lamp is fitted with an upper shield chamber (52) disposed along the upper edge of the reflector (24) of the arc lamp, plus a lower shield chamber (54) disposed along the lower edge of the reflector (24). A translucent planar shield (50) is movably positioned within continuous slots (not shown) in the upper shield chamber (52) and the lower shield chamber (54). The planar shield (50) is dimensionally configured such that it will can slide as far as possible into the upper shield chamber (52), as conceptually indicated by arrow "Q", without being fully withdrawn from the lower shield chamber (54), and vice versa. Accordingly, the planar shield (50) at all times will completely span the space between the upper and lower edges of the reflector (24), thereby shielding the arc chamber (22) from contact with airborne particulate matter, regardless of the position of the planar shield (50).

Means are provided for reciprocating the planar shield (50) between the upper and lower shield chambers (52, 54), each of which in turn includes means for cleaning the planar shield (50) as it moves in and out of the shield chambers. The shield chambers (52, 54) may include wiper blades or soft cloths (not shown) to contact and clean the shield as it reciprocates in and out of the shield chamber. The reciprocating movement of the planar shield (50) and the continuous cleaning action of the upper and lower shield chambers (52, 54) prevent or minimize undesirable accumulation of particulate matter on the planar shield (50), thereby preventing or minimizing physical interference with the transmission of light from the arc chamber (22) through the planar shield (50). As with the other embodiment, the enclosure created by the planar shield (50) may be slightly pressurized with a source of clean or filtered air to prevent ingress of particulate matter during operation.

The shield (50) may be reciprocated using any suitable mechanical means (not shown) such as an electric motor and a suitable configuration of gears to cause reciprocal vertical motion of the shield.

It will be readily seen by those skilled in the art that various modifications of the present invention may be devised without departing from the essential concept of the invention, and all such modifications and adaptations are expressly intended to be included in the scope of the claims appended hereto.

Calculations On the Theory Of Thermal Stress Rock Breaking Ignoring the effects of thermal convection (which are very small), and assuming that the heating is uniform, the temperature of a rock surface is governed simply by radiation and heat capacity. Thus, the temperature, T, is described instantaneously by:

$$\varepsilon_{abs} I = \rho Cp \frac{\partial T}{\partial t} dx + k \frac{dT}{dx} + \varepsilon_{emis} \sigma T^4 \tag{2}$$

where the first term is radiative energy transfer with an effective absorption of $\square_{abs}$. The next term is the thermal heat capacity of a layer dx thick and p is the density and Cp is the heat capacity both of which vary slightly with temperature. These calculations assume the properties do not vary with temperature and are those given below. The following term is the thermal diffusion through the rock perpendicular to the surface with k the thermal conductivity. The final term is the thermal emission where $\square_{emis}$ is the effective total hemispherical emissivity and $\square$ is Stefan-Boltzmann's constant. This equation (2) uses effective emissivities and not a wavelength dependent emissivity. Integration over the absorption and emission spectra may result in two different effective emissivities, however, these calculations assume they are the same. The simplifying assumption is made that both are constant at 0.7. Obviously, the thermal emission and the absorption terms are used only at the rock's surface.

Using equation (2), at steady state the rock temperature is given by:

$$T^4 = \frac{\varepsilon_{abs}}{2\varepsilon_{emis}} I \tag{3}$$

which assumes the emission occurs from both sides and the thermal diffusion is small compared to radiation, which is true at elevated temperatures. Taking the derivative and substituting back into this equation gives a temperature variation for emission or intensity:

$$\frac{\partial T}{T} = \frac{\partial I}{4I} \text{ or } \frac{\partial T}{T} = \frac{\partial \varepsilon}{4\varepsilon} \tag{4}$$

Hence, at 100° C. or 373° K., a 1 percent variation in energy transfer intensity or emissivity gives a variation of 0.9° C.

The effect of this temperature variation on processes like diffusion must be determined. Since these processes are time-temperature dependent a weighted process parameter will be used. This is the equivalent time given by equation [5]:

$$t_{eff} = \int exp[E_a(1/T - 1/T_{ref})/k_b] dt \tag{5}$$

where $E_a$ is the activation energy of the process in equation [5] and $T_{ref}$ is the target temperature for the process and $k_b$ Boltzmann's constant=8.61 $7\times10^{-5}$ eV/K. Obviously, the equivalent time is the length of time for the process at the target temperature. So, for a 100° C. process for 1 sec the equivalent time is 1 second as expected. If the process is at T=110° C. the equivalent time is 0.90 seconds. It is quite evident that the times involved do not allow much conduction of heat into the rock interior.

Since the integration to find equivalent time is difficult and the energy transfer process is much more complex than the square profile used in this example a computation model of the energy transfer will be used to evaluate the variation in heating effects on the equivalent time and temperature.

The computational model is formulated from equation 1 above as follows:

At the surface of the rock.

$$\Delta T_0^{s+1} = \frac{\Delta t}{\Delta x \rho Cp}\left[\varepsilon_{abs} I - \varepsilon_{emis}\sigma(T_n^s)^4 - k\frac{(T_0^s - T_{n-1}^s)}{\Delta x}\right] \tag{5}$$

and on the backside of the surface $$\Delta T_n^{s+1} = \frac{\Delta t}{\Delta x \rho Cp}\left[-\varepsilon_{emis}\sigma(T_n^s)^4 - k\frac{(T_n^s - T_{n-1}^s)}{\Delta x}\right] \tag{6}$$

and for the bulk away from the surfaces $$\Delta T_n^{s+1} = \frac{\Delta t}{\Delta x \rho Cp}\left[-k\frac{(T_n^s - T_{n-1}^s)}{\Delta x}\right] \tag{7}$$

Here, n denotes the spatial node (spacing Δx) through the rock and s is the time step, Δt. The model energy transfer is always from the lamp side. The above equations are paced in time to reach a target temperature to break rock. The runs use 10 equally spaced slices through a rock surface 1.0 cm thick. Emissivity is set at 0.7 for both absorption and emission.

A constant input power is used to reach the target temperature at which the rock starts to fracture. At the rock fracture the lamp is using constant power. The rate at which the rock is heated is given by:

$$\Delta T_0^{s+1} = \frac{\Delta t}{\Delta x \rho Cp}\left[\varepsilon_{abs} I - k\frac{\Delta T}{\Delta x} - \varepsilon_{emis}\sigma T^4\right]$$

The rate of temperature change on the rocks surface is approximately:

$$\frac{\Delta T_0^{s+1}}{\Delta t} = \frac{\varepsilon_{abs} I}{\Delta x \rho Cp}$$

The measured experimental valve of I=3000w/cm$^2$ over 10 cm$^2$ or 3.0 w/cm$^2$ over 10,000 cm$^2$ at full power of the lamp. Doing an example calculation for rock type Granite at 0.1 cm. depth to see how fast the temperature changes (Rock data given below):

Assume: $\epsilon$=0.7

$\Delta$x=0.1 cm.

$\rho$=2.67 gm/ cm$^3$

Cp=0.195 Btu/(lb.F)=4.187 J/(gm.K)/(Btu/(lb.F)) * 0.195 Btu/(lb.F)

Cp=0.816 J/(gm.K)

Therefore:

$$\frac{\Delta T}{\Delta t} = 0.7 \times 3.0 \text{ J} \frac{1}{\text{sec.}} \times \frac{\text{cm}^3 * \text{gm} * \text{K}}{2.67 \text{ gm} * 0.816 \text{ J} * 0.1 \Delta x \text{ cm}^3}$$

$$= 9.64 \text{ K/sec}$$

Using equation (7) above we can calculate the internal temperature ($T_{n-1}$) approximately 1 cm. into the rock body as a difference from the surface temperature $(T_n)^s$:

$$T_n^s - T_{n-1}^s = -9.64 \frac{\text{K}}{\text{sec.}} * \Delta x^2 \text{ cm}^2 * 2.67 \frac{\text{gm}}{\text{cm}^3} * 0.816 \frac{\text{J}}{\text{gmK}} * \frac{\text{sec} \cdot \text{cm} \cdot \text{K}}{0.4 \text{ J}}$$

Therefore:

$$T_n^s - T_{n-1}^s = -52.5K$$

If we assume the rock breaks from shear stress, the temperature differences required to achieve that are given in Table No.1. Shear stress again is clearly one of the modes that may cause the rock to break. Because the heated rock will expand, the heated rock may just shear away from the rock that does not expand. The rock may also break because of a combination of tensile and shear stresses.

TABLE No. 1

Temperature Difference Required To Break Rock Via Shear Stress (Calculated using Hook's Law)

| | If shear = 10% compressive ΔT° F. (10%) | If shear = 20% compressive ΔT° F. (20%) |
|---|---|---|
| Granite | 66.4 | 132.9 |
| Limestone | 25 | 50 |
| Marble | 35.3 | 70.6 |
| Sandstone | 56.4 | 112.7 |
| Slate | 1.7 | 3.4 |

What is claimed is:

1. A method of fracturing rock by inducing shear stress on the rock surface, comprising the step of directing radiation generated by a high-intensity arc lamp operating in excess of 4000° C. onto the rock surface.

2. The method of claim 1 wherein the arc lamp operates in excess of 8000° C.

3. The method of claim 2 wherein the arc lamp operates at about 12,000° C.

4. The method of claim 1 wherein the induction or shear stress is alternated with tensile stress induced by the use of the arc lamp at an intensity less than that required for the induction of shear stress.

5. A method of fracturing a brittle material, comprising the step of directing radiation generated by a high-intensity arc lamp operating in excess of 4000° C. upon a mass of rock until the rock fractures due to induced thermal stresses.

6. The method of claim 5 wherein the brittle material comprises rock.

7. The method of claim 5 wherein the brittle material comprises ceramic material.

* * * * *